US005707055A

United States Patent [19]

DeJoseph et al.

[11] Patent Number: 5,707,055

[45] Date of Patent: Jan. 13, 1998

[54] METHOD AND SYSTEM FOR PRODUCING MULTIPLE PART BUSINESS FORMS

[75] Inventors: Anthony B. DeJoseph, East Amherst; Jimmie A. Harrod, Grand Island; Dominick L. Monico, Williamsville, all of N.Y.

[73] Assignee: Moore Business Forms, Inc., Grand Island, N.Y.

[21] Appl. No.: 650,445

[22] Filed: May 20, 1996

[51] Int. Cl.[6] ..... B65H 39/00

[52] U.S. Cl. ..... 270/52.02; 270/52.1; 270/52.12

[58] Field of Search ..... 270/52.02, 52.07, 270/52.1, 52.12

[56] References Cited

U.S. PATENT DOCUMENTS

| | | | |
|---|---|---|---|
| 2,132,827 | 11/1938 | Meisel . | |
| 2,869,864 | 1/1959 | Burgmer | 270/52.1 |
| 3,464,350 | 9/1969 | Shoup et al. . | |
| 4,065,117 | 12/1977 | Thorsheim | 270/52.02 |
| 4,179,107 | 12/1979 | Harris . | |
| 4,235,430 | 11/1980 | Fulk | 270/52.1 |
| 4,593,893 | 6/1986 | Suter | 270/52.12 |
| 4,939,888 | 7/1990 | Katz et al. . | |
| 5,065,992 | 11/1991 | Crowley . | |
| 5,117,610 | 6/1992 | Hartman et al. . | |
| 5,207,412 | 5/1993 | Coon, Jr. et al. | 270/52.02 X |
| 5,429,698 | 7/1995 | Hartman et al. . | |

*Primary Examiner*—Hoang Nguyen
*Attorney, Agent, or Firm*—Nixon & Vanderhye

[57] ABSTRACT

Multi-part business forms having speciality electronically imaged indicia are produced in a low-cost, high speed, low waste, and enhanced flexibility method. While two part or four or more part forms may be produced, especially advantageous is the production of three part forms, such as airbills. After individual first, second and third parts are produced using conventional presses, the individual webs are separately fed to a collator and while fed to the collator are electronically imaged with speciality indicia, such as the name and address of the sender, airbill number, and—for the third part—a bar code. The webs are then collated on the collator, two business forms wide. A three part airbill produced includes first and second parts of carbonless paper stock having personalized first indicia electronically imaged on them, and a third part of carbonless label stock having the personalized indicia, and including bar code indicia, electronically imaged on it. A system for producing the forms includes a collator, a web unwind, a feeding device and electronic imager for each web unwind, and a computer control for controlling the electronic imagers and the collator so that matching indicia is provided on the multiple parts of each form of the common web produced.

16 Claims, 4 Drawing Sheets

METHOD AND SYSTEM FOR PRODUCING MULTIPLE PART BUSINESS FORMS

BACKGROUND AND SUMMARY OF THE INVENTION

In the practical production of multiple part business forms which require bar code indicia on one of the parts, and numbering indicia on all of the parts with each form consecutively numbered, there are a number of different techniques utilized. Two common techniques are utilized for the production of such forms which are constructed as three part airbills for courier services or the like, where the third part is of label stock and has bar code indicia imaged thereon. The bar code must be applied utilizing a special electronic imaging unit, such as a MIDAX electrostatic printer available from Moore Business Forms of Lake Forest, Ill.

In one conventional method of producing three part airbills, the first two parts—of paper stock (typically carbonless paper stock, such as MCP 2010)—are run on a conventional four-wide press (such as a 32" TMSW press). The third part is run on label stock (e.g., Fasson DSX label stock), and is run on a one-wide Webtron press equipped with an electronic imager (e.g., a MIDAX printer) to produce a bar code, which is then subsequently overprinted with clear varnish to ensure that the bar code maintains its integrity. Then the three webs are collated in a single width collator (the first and second parts cut down from four wide to one wide). A consecutive number corresponding to at least a numerical part of the bar code earlier imaged on the third part is then crash imprinted (impact printed) on the forms. Since the forms are carbonless, printing of the number on the first part is also transferred to the second and third parts.

According to another conventional method, parts one and two are produced from carbonless stock (e.g., MCP 6010) on a conventional multiple wide printing press (such as a TMSW). The press may be equipped with a Scitex printer for imprinting a consecutive number on the form parts. For the third part, label stock is run on a one wide Webtron press equipped with a MIDAX printer as described above. Then the webs are collated, one wide, matching all of the plies based upon the consecutive number earlier printed thereon.

After the basic forms are produced utilizing the methods described above, the forms are packed in cartons in continuous format and shipped to the courier service. The courier service typically crash imprints (that is impact prints) individual customer information, such as name and address, on various quantities of the forms which are then individually packaged and shipped to the specific customer.

According to the present invention, a method of producing multi-part business forms that can be used for a wide variety of multiple part business forms, but is particularly useful as an advantageous alternative to the methods described above, is provided. According to the present invention it is possible to produce business forms substantially identical to those produced by the conventional techniques as described above only having elements thereof that are of even higher quality, at reduced cost (e.g., at a cost of manufacture that is about 5% less compared to present conventional procedures as described above). Despite the lower production costs, the method according to the present invention allows greater flexibility, for example allowing almost any personalized information to be printed on all or any selected part of the forms. Typically, according to the invention the form parts are personalized with high quality imaged (electronic image) information like name and address information, obviating the need for an impact printing step that the courier companies are now forced to employ when the conventional processes described above are utilized. The invention is also capable of higher speed with less waste, wider web press runs (four-wide on both parts one and two, and two-wide on part three), and can utilize a two-wide collation process. The system and method according to the present invention, as well as the multiple part form produced thereby, thus have numerous advantages compared with the prior art without the introduction of any disadvantages.

According to one aspect of the present invention, a method of producing multi-part business forms having speciality electronically imaged indicia thereon is provided. The method comprises the following steps: (a) Producing at least first and second business form webs having blanks to be filled in and indicia associated with the blanks. (b) Separately feeding the first and second business form webs produced during the practice of step (a) to a collator. (c) While practicing step (b), electronically imaging specialty indicia on each of the first and second business form webs, including first indicia that is the same on each of the first and second business form webs. And (d) after step (c), collating the first and second webs on the collator to produce multiple part business forms each including a part from each of the first and second webs, with matching first indicia.

Steps (b) and (c) are typically practiced using first and second business form webs that are two business forms wide. The method can be practiced effectively to produce two part business forms, four (or more) part business forms, or three part forms. The production of three part forms, especially with the third part of label stock, takes maximum advantage of all of the improvements that can be provided by the process according to the invention. That is, step (a) is practiced to produce first, second and third business form webs each having blanks to be filled in and indicia associated with the blanks, and steps (b)–(d) are practiced with the first, second and third webs each two business forms wide, and each web having matching first indicia thereon.

Step (c) is typically practiced to electronically image bar code indicia on the third web, the bar code indicia preferably being imaged with a high quality electronic (e.g., electrostatic) imager, such as a Nipson-Bull 18" wide printer having high toner fusing quality. That is an electronically imaged bar code is produced that is uncovered with varnish or other protective coating during the practice of step (d). The third web is of label stock, and step (c) is typically practiced to image human readable numerical indicia as at least part of the first indicia, the human readable numerical indicia corresponding at least in part to the bar code indicia. Step (a) may be practiced to produce the first and second webs four business forms wide, and to produce the third web two business forms wide; and there may be the further step (e), between steps (a) and (b), of slitting the first and second webs so that there are two business forms wide.

While the method as described above may be used for producing any type of multiple part business form, it is particularly advantageous for the production of three-part airbills, and according to another aspect of the present invention, a three-part airbill having advantages compared to the prior art in readability of components, is provided. The three-part airbill according to the present invention comprises: a first part of paper stock having personalized first indicia, including name and address indicia, electronically imaged thereon; a second part of paper stock having the personalized first indicia, including name and address indicia, electronically imaged thereon; and a third part of label stock having the personalized first indicia, including name and address indicia, electronically imaged thereon, and including bar code indicia electronically imaged thereon.

The bar code indicia that is imaged has high quality fusing so that it is uncovered by clear varnish or another protective coating. Typically, at least two of the parts include carbonless coatings (that is the first part may be CB, second part CFB, and the third part CF; or the second and third parts can have self-imaging coatings on the top faces thereof) so that indicia impact printed or written on the first part is transferred to the second and third parts. The carbonless coatings may be over substantially the entire forms, or in selected spots.

Typically, each of the first, second or third parts have aligned top and bottom edges and at least one of the top and bottom edges of each of the first, second and third parts is connected by a line of weakness to like first, second and third parts, respectively, of a like airbill. The personalized first indicia on each of the parts may comprise substantially complete shipment details indicia, and the first indicia may also comprise human readable numerical indicia corresponding at least in part to the bar code indicia (or human readable numerical indicia may be impact printed on, particularly where carbonless parts are utilized)

According to yet another aspect of the present invention, a system for producing multiple-part business forms is provided comprising the following components: A collator for collating multiple webs of business forms to produce a common web of multiple part business forms. First and second web unwinds. First and second web feeding means connected to the first and second web unwinds, respectively, for feeding first and second webs from the unwinds to the collator. First and second electronic imagers associated with the first and second web feeding means, respectively, for electronically imaging matching indicia on first and second webs while being fed by the first and second web feeding means to the collator. And a computer control for controlling the electronic imagers and the collator so that matching indicia is provided on the multiple parts of each form of the common web. The computer control may comprise an XL Data System, such as available from Moore Business Forms of Lake Forest, Ill. The electronic imagers may comprise MIDAX printers, Nipson-Bull imagers, or Scitex imagers. These imagers are all capable of obtaining the required bar code resolution for airbills despite the fact that carbonless paper or label stock is utilized.

The system according to the present invention preferably further comprises: A third web unwind, a third web feeding means, and a third electronic imager. The third web feeding means is connected to the third web unwind and the collator. The third electronic imager is associated with the third web feeding means for electronically imaging matching indicia on the third web while being fed by the third web feeding means to the collator. And the computer control controls the third electronic imager and the collator so that matching indicia is provided on first, second and third parts of each form of the common web. The third electronic imager is capable of imaging high resolution (so they may be uncoated) bar code indicia on a carbonless label stock third web.

It is a primary object of the present invention to provide for the low cost, high flexibility, production of multiple-part business forms, including three-part carbonless airbills—the third part of label stock. This and other objects of the invention will become clear from an inspection of the detailed description of the invention and from the appended claims.

DETAILED DESCRIPTION OF THE DRAWINGS

Figure 1:
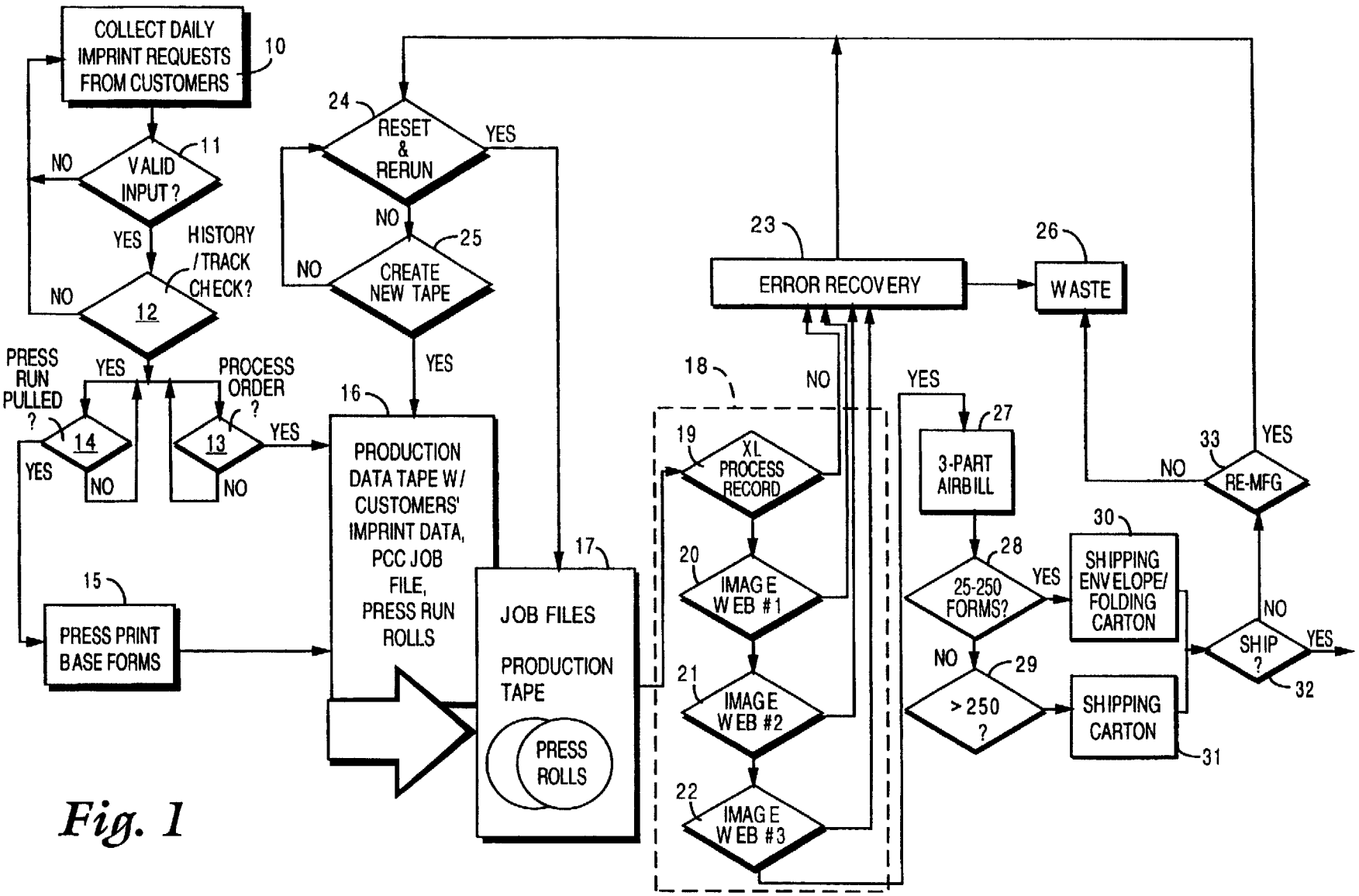
FIG. 1 is a high level flowchart schematically illustrating various method steps that may be practiced according to an exemplary method of the present invention.

FIG. 1 schematically illustrates the various steps that are practiced in the production of multiple-part business forms according to the present invention, particularly in the production of three-part airbills. As indicated by block 10, there is essentially daily collection of imprint requests from customers by the manufacturer of the forms. After collection of the requests, they are evaluated as indicated by decision blocks 11 and 12, with a yes response in both resulting in input to "process order" decision block 13, and "press run pulled" decision block 14. All of these process steps may be practiced utilizing a computer, as can most of the subsequent steps.

As indicated by action block 15, once the appropriate information has been received and processed, the basic forms are press printed. For example, if a three-part airbill is to be printed, pursuant to block 15, the first and second parts may be produced from carbonless paper stock (such as MCP 2010, or MCP 6010) on conventional presses, such as in a four-wide format on a 32" TMSW conventional press capable of running at 600 feet per minute. The third part is produced, according to block 15, for example, on Fasson DSX label stock, two-wide, for example, at about 180 feet per minute. During the practice of step 15, lines of weakness (typically perforation lines) between individual forms are formed, as well as any punching of margins, or the like, that is necessary or desirable, and form blank spaces that are to be filled in by the user, including indicia describing what the blank spaces mean, is printed. For example, for an airbill, blanks may be provided which have indicia associated therewith indicating customer code number, the priority of delivery, the weight of the package, the contents of the package, the shipping and/or return addresses, the date, etc.

The output from block 13 and the forms and output from block 15 are provided as inputs to the block 16, which then provides the necessary data and implements in block 17 to produce a production tape for electronically imaging the individual webs as they are fed to a collator. The block indicated schematically in dotted line by reference numeral 18 in FIG. 1 is the collator related process and steps, including decision block 19 relating to the computer control for the electronic imaging and collation, which may be provided by a Moore XL Data System, and decision blocks for each of the web imagers (such as Nipson-Bull imagers) is indicated by decision blocks 20–22 assuming three webs to be imaged. Error recovery, for false data provided in 19–22, is indicated schematically at 23, which can provide for reset and rerun as indicated by decision block 24, or the creation of a new tape as indicated by decision block 25, the block 25 associated with the block 16, the block 24 with the block 17. Where error recovery is not practical, the erroneously produced forms may be disposed of and the paper recycled, as indicated schematically by block 26 in FIG. 1.

Assuming successful production of the three-part airbills as indicated at block 27 at FIG. 1, the forms are individually packaged (with appropriate folding and bursting or cutting), for example, in small packages as indicated by decision block 28 or larger packages as indicated by decision block 29. The ultimate shipping envelope or large carton produced, as indicated schematically by blocks 30 and 31 in FIG. 1, are subsequently shipped as indicated by decision block 32 in FIG. 1, or if erroneously produced or if the order circumstances change, passed to remanufacturing decision block 33.

Figure 2:
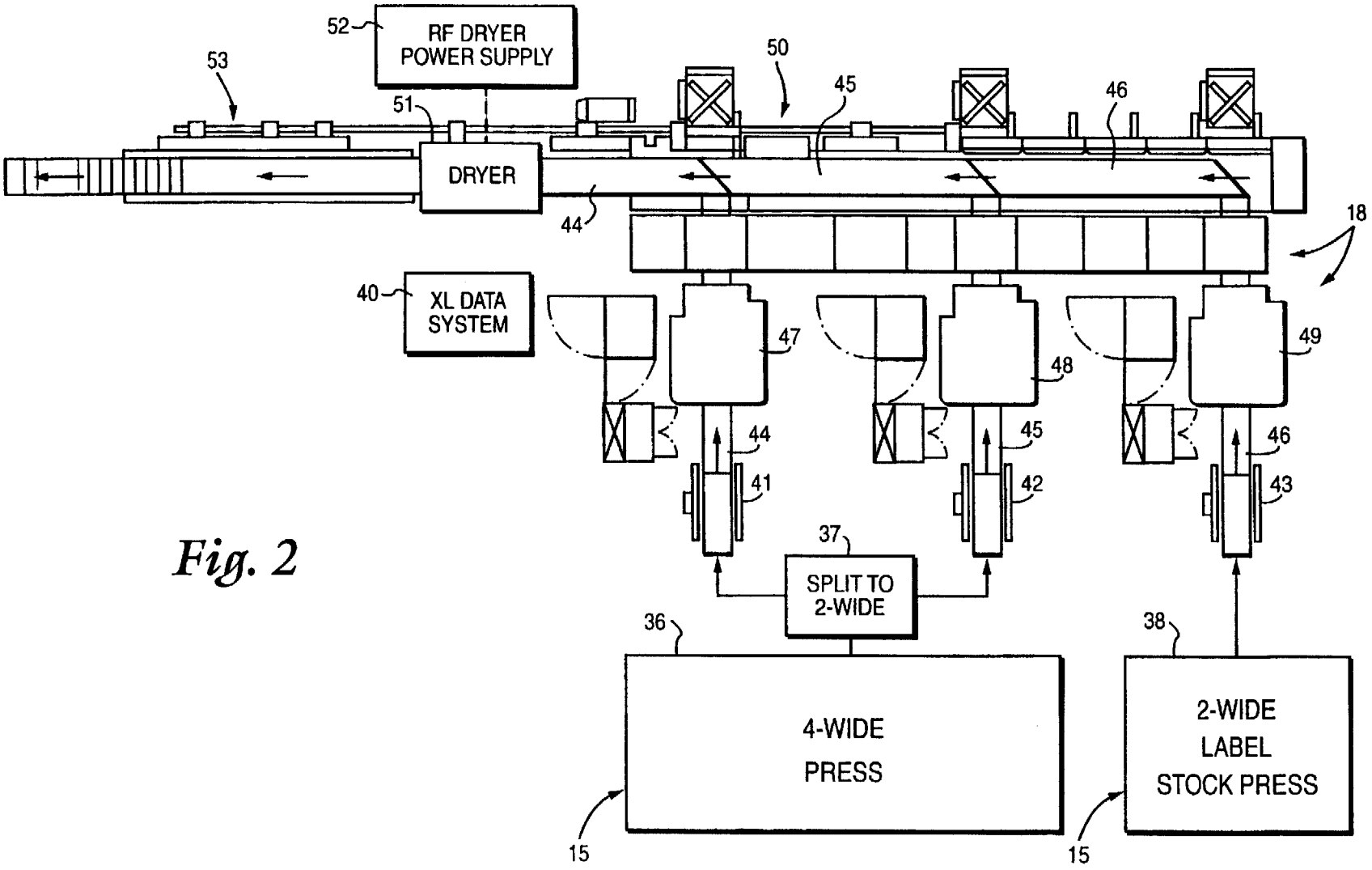
FIG. 2 is a top plan schematic view of an exemplary system utilizable according to the present invention.

FIG. 2 schematically illustrates an exemplary system for practicing the initial press printing of the base forms, as indicated by block 15 at FIG. 1, and the collating steps system schematically illustrated at 18 of FIG. 1. As earlier described, a four-wide press or presses for producing, for example, parts one and two of a three-part airbill is indicated by reference numeral 36 in FIG. 2, and may comprise a 32" TMSW press. Before parts one and two made by the press 36 are processed by the collating system 18, the four-wide business form parts are slit or burst, or otherwise processed, to produce two-wide forms, as schematically illustrated at 37 in FIG. 2. As also described above, the third part is preferably made as illustrated schematically at 38 in FIG. 2 on a 16" Webtron press, two wide.

For the collating system 18 in FIG. 3, a description will be given assuming that three-part airbills are being produced. Of course, more or less components can be provided if two part forms or four or more part forms are being produced, and the components may differ slightly depending upon whether one of the parts is label stock (as is common for airbills).

FIG. 2 illustrates an XL Data System 40, available from Moore Business Forms of Lake Forest, Ill., which provides the computer control and is capable of controlling multiple imagers on multiple webs as well as a collator. The system further comprises first web unwind 41, second web unwind 42, and third web unwind 43 for the first, second and third parts of the form to be produced, respectively. For example, the unwinds 42–43 may be conventional 18" wide unwind units. Associated with the unwinds are feeding means for feeding the first part web 44, second part web 45, and third part web 46, respectively to a first electronic imager 47, a second electronic imager 48, and a third electronic imager 49, respectively. The feeding means may comprise any type of conventional rolls, conveyors, feeders, and the like commonly associated with unwind units, imaging equipment, and/or collators, such as the collator 50 in FIG. 2. The feeding means for webs 44–46 may comprise separate units or be integral parts of one or more of the web unwinds 41–43, imagers 47–49, or collator 50. The feeding means will feed the webs 44–46 from the unwinds 41–43 to the collator 50.

The imagers 47–49 may comprise any suitable conventional electronic imagers, preferably of the type that are capable of electrostatically (or utilizing other electronic techniques) imaging high resolution images on carbonless paper or label stock. Preferably each of the imagers 47–49 is a Nipson-Bull 18" print width electronic imager. However, alternatively the imagers 47–49 may comprise Scitex electronic imagers or Moore MIDAX printers.

The collator 50 preferably is a two form wide collator, such as a Hamilton collator. The collator 50 is capable of a 300 feet per minute run speed, and considering 70% run time 140 feet per minute net production. Counter waste is typically about 3–4%. The collator 50 assembles all of the webs 44–46 in proper form and otherwise processes them as necessary, for example, doing any perfing, drying (e.g., using the RF dryer 51 controlled by the power supply 52), or the like that is necessary before passing on to conventional folder 53, or other processing equipment which automatically folds, bursts, slits, and/or packages the forms.

The imagers 47–49 are controlled by the XL Data System computer 40 to electronically image personalized first indicia on each of the webs 44–46. Preferably this indicia includes at least shipper name and address indicia. Imaging the indicia here—at the imagers 47–49—avoids the necessity of the courier company doing its own imaging using impact printers, and provides higher quality images, more readable on each part of the form. Also, the personalized first indicia may comprise substantially complete shipment details indicia, such as the priority of service, outgoing address, contents, and other common shipment details. Also, the imager 49 (and imagers 47 and 48 if ever desired) provides high resolution, fused bar code indicia, so that it does not need to be covered by clear varnish or another protective covering. Also, the imagers 47–49 may image human readable numerical indicia corresponding at least in part to the bar code indicia imaged by the imager 49. Alternatively, numerical indicia may be applied at the collator 50 with an impact printer at a portion of the forms where carbonless coatings are provided.

Figure 3:
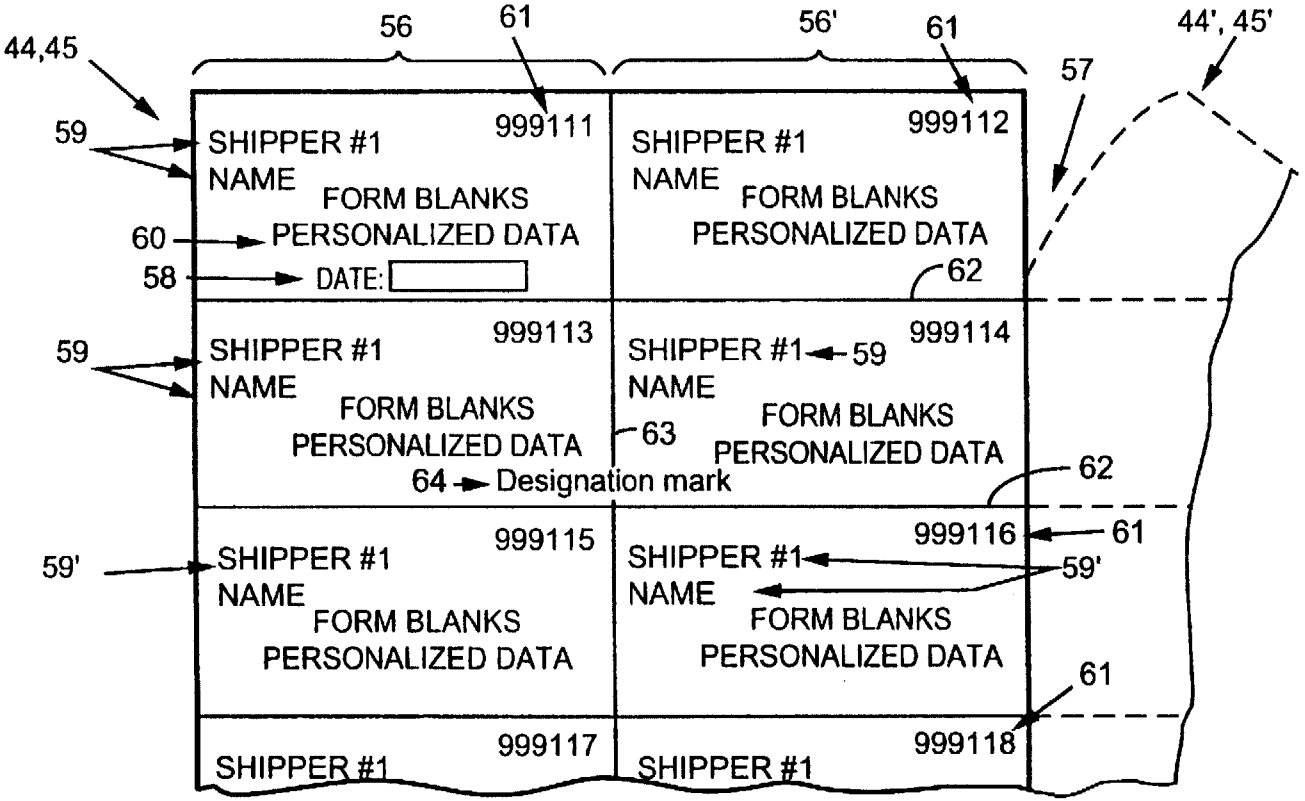
FIG. 3 is a top plan view of a web of first or second parts of an exemplary three-part form produced according to the present invention.
Figure 4:
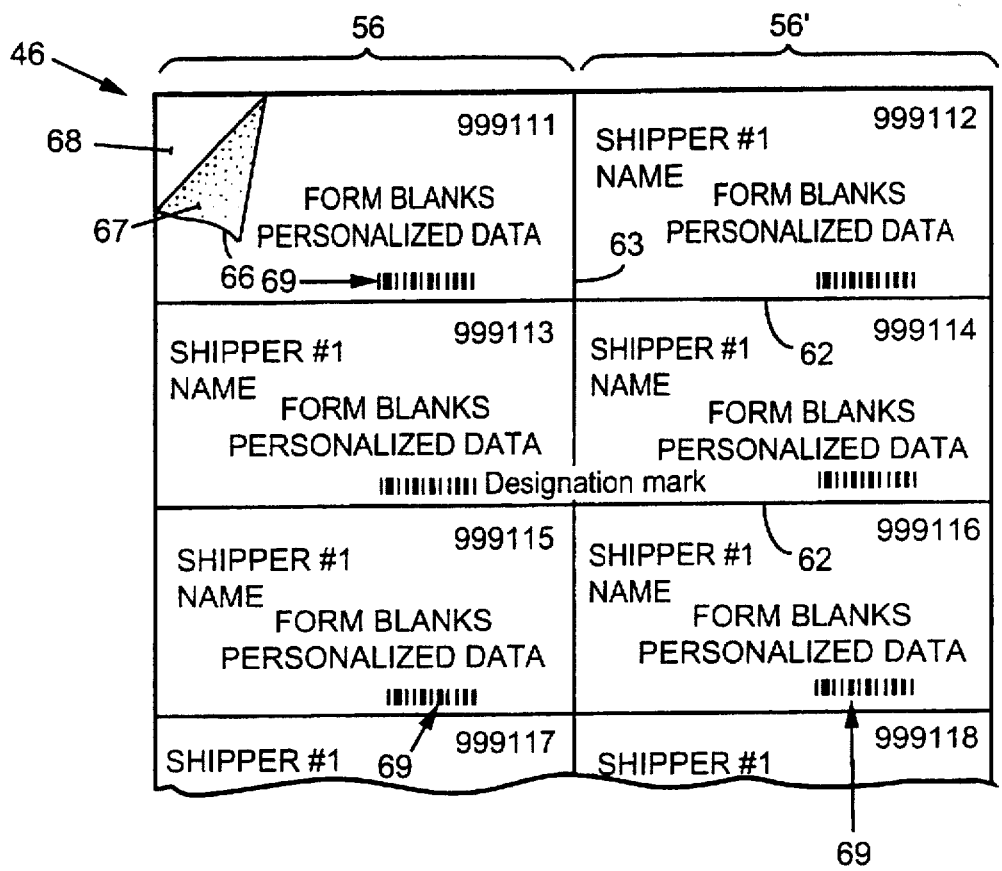
FIG. 4 is a view like that of FIG. 3 for a third part web produced according to the present invention.
Figure 5:
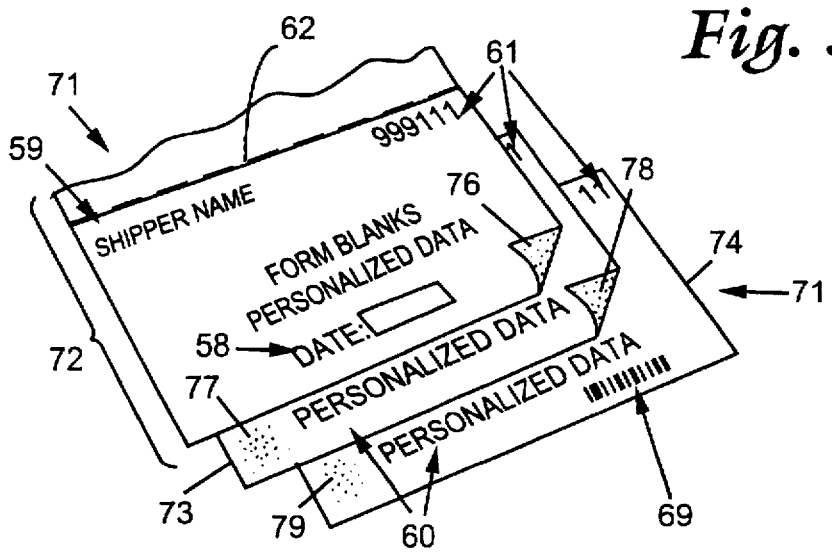
FIG. 5 is a top perspective exploded view of an exemplary three part airbill according to the present invention.

FIGS. 3–5 schematically illustrate forms at various stages of the production of forms pursuant to the present invention, and an exemplary final form produced.

FIG. 3 shows, in schematic top plan view, an exemplary first or second part of the final multiple part business form produced according to the present invention. FIG. 3 shows a web 44 or 45 which is two forms wide, as indicated by reference numerals 56 and 56', each relating to a width of forms. The web 44, 45 was originally formed by slitting or bursting—as indicated schematically at parting in line 57 in FIG. 3—into two separate webs at 37 in FIG. 2, a second such web being shown in dotted line at 44', 45' in FIG. 3.

Each form 56, 56' has had printed thereon at press 36 blanks and associated indicia, as indicated at 58 in FIG. 3. FIG. 3 only shows specific indicia 58 for one form 56, but it is to be understood that this indicia 58 (of any amount or complexity) is provided on all forms 56, 56'.

Each form 56, 56' also has had electronically imaged thereon—by imager 47, 48—shipper name and address information, as illustrated schematically at 59, as well as any other personalized indicia, which could include substantially complete shipment details as schematically illustrated at 60 FIG. 3, and which could include consecutive human readable numbers as illustrated at 61. The individual forms are separated by both "horizontal" and "vertical" lines of weakness, such as perforation lines, as indicated at 62, 63, respectively in FIG. 3. Also, the imagers 47, 48 will image a designation mark of any type (that is readily optically or magnetically read), such as illustrated at 64 in FIG. 3, when the bulk of personalized data will change. For example, when the personalized data changes for shipper number one name and address 59 to a shipper number two name and address 59', a designation mark 64 will be imaged typically on the forms 56, 56' just before a line of weakness 62 for the first form of the batch with shipper number two indicia 59'.

FIG. 4 is a top plan schematic view of an exemplary web 46 produced according to the invention. Elements of the web 46 comparable to those of the web 44, 45 are shown by the same reference numeral. The web 46 is of label stock, as schematically illustrated for the uppermost left form 56 which has a corner 66 thereof peeled back, revealing an adhesive (preferably a pressure sensitive adhesive, either permanent or removable or repositionable) 67 on the bottom face thereof. Typically a release liner, such as a silicone coated paper, is also provided as indicated at 68, although it is possible to make the web 46 of linerless label stock particularly if all of the components will be rolled and an adhesive release coating on the top face of the first part web 44 is not undesirable.

The web 46 has bar code indicia 69 also imaged thereon. Bar code indicia must be high resolution indicia, and particularly where the imager 49 is a Nipson-Bull imager, there is no necessity to coat the high resolution bar code image 69 with a clear varnish or other protective coating. While bar code indicia 69 may also be printed on the first and second part webs 44, 45, it typically is printed only on the label stock web 46. The human readable numerical indicia 61 printed on all of the webs 44–46 preferably conforms at least in part to the bar code indicia 69.

FIG. 5 schematically illustrates an exemplary final business form 71 according to the present invention made up of a first part 72 that is a form 56 or 56' from the first web 44, a second part 73 which is a form 56, 56' from a second web 45, and a third part 74 which is a form 56, 56' from the third part 46. Preferably at least two of the three parts 72–74 are carbonless paper. For example, the first part 72 may be of CB carbonless paper, the carbonless coating being illustrated schematically at 76 at FIG. 5. Part 73 may be CFB carbonless paper, the CF carbonless material being illustrated schematically at 77 and the CB material schematically at 78 on FIG. 5. The third part 74 may be a CF part, the carbonless material being indicated schematically at 79 thereon. Alternatively, part 72 may be CB, part 73 CF, with part 74 having a self-contained carbonless coating on the top surface thereof. Alternatively, both the top surfaces of the parts 73, 74 may have self-contained coatings, while the part 72 is plain paper stock, or other arrangements may also be provided. The carbonless coatings may be provided full face so that any printing or writing on the top surface of the part 72 will be transferred to both the parts 73, 74, or the coatings may be localized on one or more of the parts to provide selective transfer of information. As seen in FIG. 5, each of the forms 71 may be connected by perforation lines 62 to another like form 71 at at least the top or bottom edge thereon, and may also be in a two wide configuration even when shipped to the courier or ultimate customer.

Practicing the present invention, it is possible to effect a savings of the cost of manufacture that is approximately 5% over present cost utilizing the conventional procedures described above. This cost savings is achieved despite the fact that a more versatile product is provided, and one having more value added, including the personalized indicia 59, 60. Also, the personalized indicia 59, 60 that is provided is higher quality than typically is provided when impact printing by the courier company or other purchaser of the forms is practiced, and also the numerical indicia 61 may be of higher quality if electronically imaged rather than impact printed. Also processing speeds are faster, and there is less waste when practicing and utilizing the present invention compared to the conventional systems and processes described above.

It will thus be seen that according to the present invention an advantageous method and system for producing multiple part business forms, and an advantageous three-part airbill are provided. While the invention has herein been shown and described in what is presently conceived to be the most practical preferred embodiment thereon, it will be apparent to those of ordinary skill in the art that many modifications may be made thereof within the scope of the invention, which scope is be accorded the broadest interpretation of the appended claims so as encompass all equivalent structures, products, and processes.

What is claimed is:

1. A method of producing multi part business forms having specialty electronically imaged indicia thereon, comprising the steps of:

(a) producing at least first and second business form webs having blanks to be filled in and indicia associated with the blanks;

(b) separately feeding the first and second business form webs produced during the practice of step (a) to a collator;

(c) while practicing step (b), electronically imaging specialty indicia on each of the first and second business form webs, including first indicia that is the same on each of the first and second business form webs; and (d) after step (c), collating the first and second webs on the collator to produce multiple part business forms each including a part from each of the first and second webs, with matching first indicia.

2. A method as recited in claim 1 wherein steps (b) and (c) are practiced using first and second business form webs that are two business forms wide.

3. A method as recited in claim 2 wherein step (a) is practiced to produce first, second and third business form webs each having blanks to be filled in and indicia associated with the blanks; and wherein steps (b)–(d) are practiced with the first, second and third webs each two business forms wide, and each web having matching first indicia thereon.

4. A method as recited in claim 3 wherein step (c) is practiced to electronically image bar code indicia on the third web.

5. A method as recited in claim 4 wherein the third web is of label stock, and wherein step (c) is practiced to image human readable numerical indicia as at least part of the first indicia, the human readable numerical indicia corresponding at least in part to the bar code indicia.

6. A method as recited in claim 5 wherein step (a) is practiced to produce the first and second webs four business forms wide, and to produce the third web two business forms wide; and comprising the further step (e), between steps (a) and (b), of slitting the first and second webs so that they are two business forms wide.

7. A method as recited in claim 1 wherein step (a) is practiced to produce first, second and third business form webs each having blanks to be filled in and indicia associated with the blanks; and wherein steps (b)–(d) are practiced with the first, second and third webs each having matching first indicia thereon.

8. A method as recited in claim 7 wherein step (c) is practiced to electronically image bar code indicia on the third web.

9. A method as recited in claim 8 wherein the third web is of label stock, and wherein step (c) is practiced to image human readable numerical indicia as at least part of the first indicia, the human readable numerical indicia corresponding at least in part to the bar code indicia.

10. A method as recited in claim 3 wherein step (a) is practiced to produce the first and second webs four business forms wide, and to produce the third web two business forms wide; and comprising the further step (e), between steps (a)

and (b), of slitting the first and second webs so that they are two business forms wide.

11. A method as recited in claim 8 wherein the electronically imaged bar code indicia is uncovered with varnish or other protective coating during the practice of step (d).

12. A method as recited in claim 1 wherein steps (a) through (d) are practiced to produce a three-part airbill including a first part of paper stock having personalized first indicia, including name and address indicia, electronically imaged thereon; a second part of paper stock having said personalized first indicia, including name and address indicia, electronically imaged thereon; and a third part of label stock having said personalized first indicia, including name and address indicia, electronically imaged thereon, and including bar code indicia electronically imaged thereon.

13. A method as recited in claim 7 wherein steps (a) through (d) are practiced to produce a three-part airbill including a first part of paper stock having personalized first indicia, including name and address indicia, electronically imaged thereon; a second part of paper stock having said personalized first indicia, including name and address indicia, electronically imaged thereon; and a third part of label stock having said personalized first indicia, including name and address indicia, electronically imaged thereon, and including bar code indicia electronically imaged thereon.

14. A system for producing multiple part business forms, comprising:

a collator for collating multiple webs of business forms to produce a common web of multiple part business forms;

first and second web unwinds;

first and second web feeding means connected to said first and second web unwinds, respectively, for feeding first and second webs from said unwinds to said collator;

first and second electronic imagers associated with said first and second web feeding means, respectively, for electronically imaging matching indicia on first and second webs while being fed by said first and second web feeding means to said collator; and a computer control for controlling said electronic imagers and said collator so that matching indicia is provided on the multiple parts of each form of the common web.

15. A system as recited in claim 14 further comprising a third web unwind, a third web feeding means, and a third electronic imager; said third web feeding means connected to said third web unwind and said collator; said third electronic imager associated with said third web feeding means for electronically imaging matching indicia on said third web while being fed by said third web feeding means to said collator; and said computer control controlling said third electronic imager and said collator so that matching indicia is provided on first, second and third parts of each form of the common web.

16. A system as recited in claim 15 wherein said third electronic imager is capable of imaging uncoated, high resolution, bar code indicia on a carbonless label stock third web.

* * * * *